US005357680A

United States Patent [19]

Monistere

[11] Patent Number: 5,357,680

[45] Date of Patent: Oct. 25, 1994

[54] FINGER RAZOR

[76] Inventor: Angelo J. Monistere, 4317 Winfield St., Metairie, La. 70001

[21] Appl. No.: 1,523

[22] Filed: Jan. 6, 1993

[51] Int. Cl.[5] ..... B26B 27/00; B26B 21/00

[52] U.S. Cl. ..... 30/298; 30/32

[58] Field of Search ..... 30/32, 85, 298, 340, 30/30, 298

[56] References Cited

U.S. PATENT DOCUMENTS

| | | | |
|---|---|---|---|
| 977,919 | 12/1910 | Yeaton, Jr. | 30/32 |
| 2,601,388 | 6/1952 | Guarino | 30/32 |
| 2,794,246 | 6/1957 | Marsh et al. | 30/32 |
| 2,888,745 | 6/1959 | Beck | 30/298 |
| 3,014,506 | 12/1961 | Crimmins et al. | 30/298 |
| 4,177,698 | 12/1979 | Greneker | 30/298 |

*Primary Examiner*—Richard K. Seidel
*Assistant Examiner*—Paul M. Heyrana, Sr.

[57] ABSTRACT

A finger razor comprising a tapered sleeve, base plate, top plate, and retainer is set forth. The tapered sleeve fits snugly onto the middle or index finger. The tapered sleeve is attached to a base plate, on which a razor blade rests. The base plate has plural teeth. The top plate fits over the razor blade and creates a cradle for the blade. The retainer cover holds the base plate, the razor blade, and the top plate securely.

4 Claims, 3 Drawing Sheets

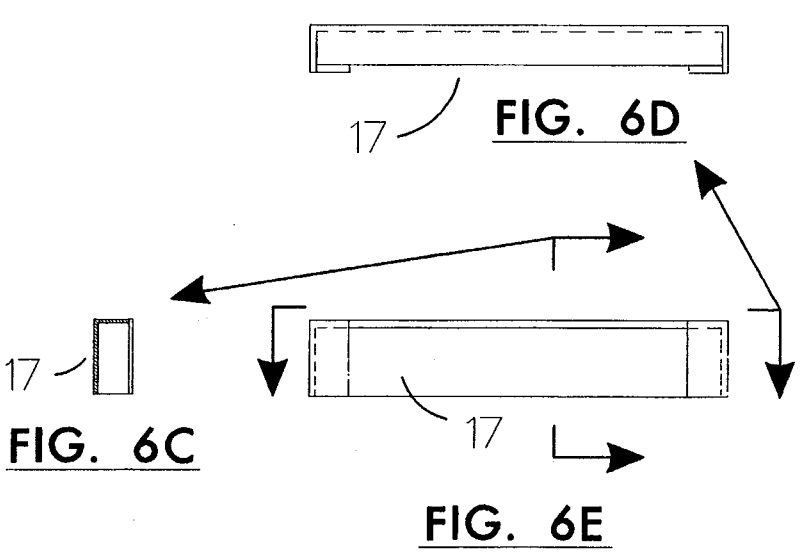
FIG. 6D
FIG. 6E
FIG. 6C
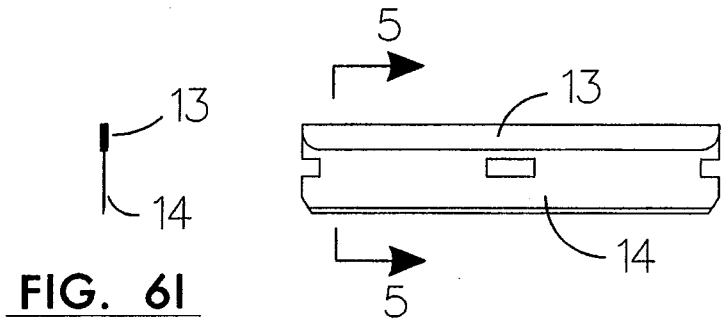
FIG. 6H
FIG. 6I
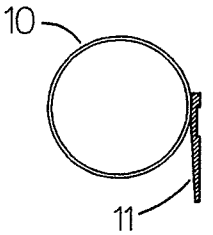
FIG. 6B
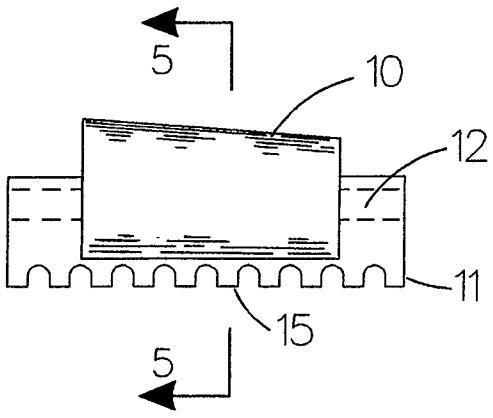
FIG. 6A
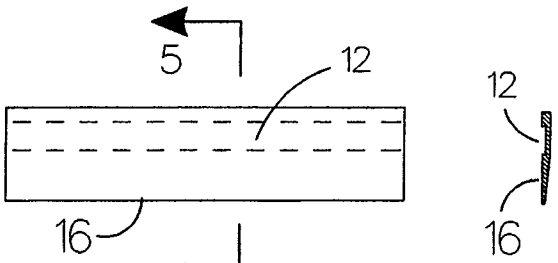
FIG. 6G
FIG. 6F

FINGER RAZOR

BACKGROUND OF THE INVENTION

The background of the finger razor is set forth as follows:

1. Field of the Invention

This invention relates to a razor blade worn on any finger of any human hand as applied to the manual art or field of human haircutting in the area of the human skull.

Another object of this invention is to provide a razor blade holder which allows a haircutter to remove bulk hair, texturize hair, shape hair, thin hair, blend and cut hair.

Another object of this invention is to provide a razor blade holder which allows a haircutter to simultaneously hold and cut hair using one hand.

2. Description of the Prior Art

Under the field of haircutting around the human skull, the ability to hold and cut hair simultaneously requires the use of two hands.

This invention of a finger razor allows haircutting around the human skull requiring the use of one hand only.

SUMMARY OF THE INVENTION

The present invention is directed to a Finger Razor that satisfies the needs that I have mentioned in the Background.

A Finger Razor having features of the present invention, comprises a tapered sleeve attached to a base plated with plural teeth, a top plate, and a retainer cover that slides over the two plates and holds them securely.

The Finger Razor that I have manufactured will fit on the middle finger or the index finger of the person using it. As the hair is held between the middle finger and the index finger, and as the hand is moving from the base of the hair to the ends of the hair, the hair is being cut, shaped, thinned, or texturized by the Finger Razor. The Finger Razor is novel because the hair is cut by the two fingers holding the hair, instead of being cut by an instrument held in another hand.

This Finger Razor can be made from a variety of materials. It can also be made to hold a razor blade in various positions. It can be made to house different sized razor blades. The Finger Razor can also be made to fit either hand.

The Finger Razor is practical because it is very light in weight and compact in size. Also, results are achieved quickly and easily. The Finger Razor can be mass produced at a modest cost. For these reasons, there is a need for the Finger Razor in the Hair Cutting and Styling industry.

As discussed above, the Finger Razor has a tapered sleeve which, when fitted properly, fits snugly on the middle finger, or index finger of the hand. The tapered sleeve is made of thin plastic that is wrapped around itself to fit snugly and comfortably around the finger on which it is being used. The material used for this sleeve is thin enough not to interfere with the holing of the hair between the middle and index fingers. To this sleeve, is attached a base plate that serves as a platform on which a razor blade rests. This base plate has plural teeth so that a person cannot, under normal circumstances, cut themselves. The equally spaced teeth allow the hair to be fed into the spaces between these teeth. This plate is also notched, so that when a razor blade rests on the plate, the ridged portion on the opposite end of the blade's edge will rest in this notched space.

When the blade sits on the base plate, it is covered by the top plate. This top plate is equal in thickness to the base plate, and is also notched so that it will fit over the ridged portion of the razor blade. This top plate rests on the razor blade, creating a cradle for the blade. The top plate's width does not cover the entire blade, but extends only to the base of the teeth on the base plate. The top plate is also tapered on the edge that faces the teeth of the base plate.

The retainer slides over the base and top plates, holding them securely. The retainer is open in the front and wraps around the ends of the base plate and the top plate, holding the two plates together. The retainer holds the plate system of the finger razor securely.

This finger razor is worn either on the middle or the index finger. One variation of use of the Finger Razor is when the razor is on the middle finger, with the blade facing the user, located on the bottom of the finger. While holding the hair between the middle finger and the index finger, and moving from the base of the hair to its ends, the hair can be easily thinned or texturized. With a slight twist of the fingers, the hair can be cut.

The Finger Razor is novel because hair is cut by the two fingers holding the hair, instead of being cut by an instrument held in another hand. The Finger Razor is very light in weight. It is also compact in size, and is efficient to use. It can be made very economically. It s also a lot of fun to use.

The Finger Razor can be made of various combinations of metal, plastic, and other materials. The parts of the Finger Razor can be attached to each other with an adhesive, or they can be made from a mold, all or in part.

The finger sleeve may or may not have holes in it. The sleeve may be replaced by plural finger rings. The razor may be any color or made using various translucent materials.

BRIEF DESCRIPTION OF DRAWINGS

FIG. 6*a* shows an external view of the device shown in FIG. 1 disassembled showing the finger sleeve and base plate.

FIG. 6*b* shows a cross-sectional view of the device disassembled showing the finger sleeve and base plate, the section being taken as on Line 5—5 in FIG. 6*a*.

FIG. 6*c* shows a cross-sectional view of the retainer, the section being taken as on Line 5—5 in FIG. 3.

FIG. 6*d* shows a view of the retainer, the section being taken as on Line 4—4 in FIG. 3.

FIG. 6*e* shows an external view of the retainer as shown in FIG. 3.

FIG. 6*f* shows a view of the top plate illustrating the notch in the top plate.

FIG. 6*g* shows a cross-section view of the top plate, the section being taken as on Line 5—5 in FIG. 6*f*.

FIG. 6*h* shows a view of the razor blade.

FIG. 6*i* shows a cross-sectional view of the razor blade, the section being taken as on Line 5—5 in FIG. 6*h*.

DESCRIPTION OF THE PREFERRED EMBODIMENT OF THE INVENTION

Figure 1:
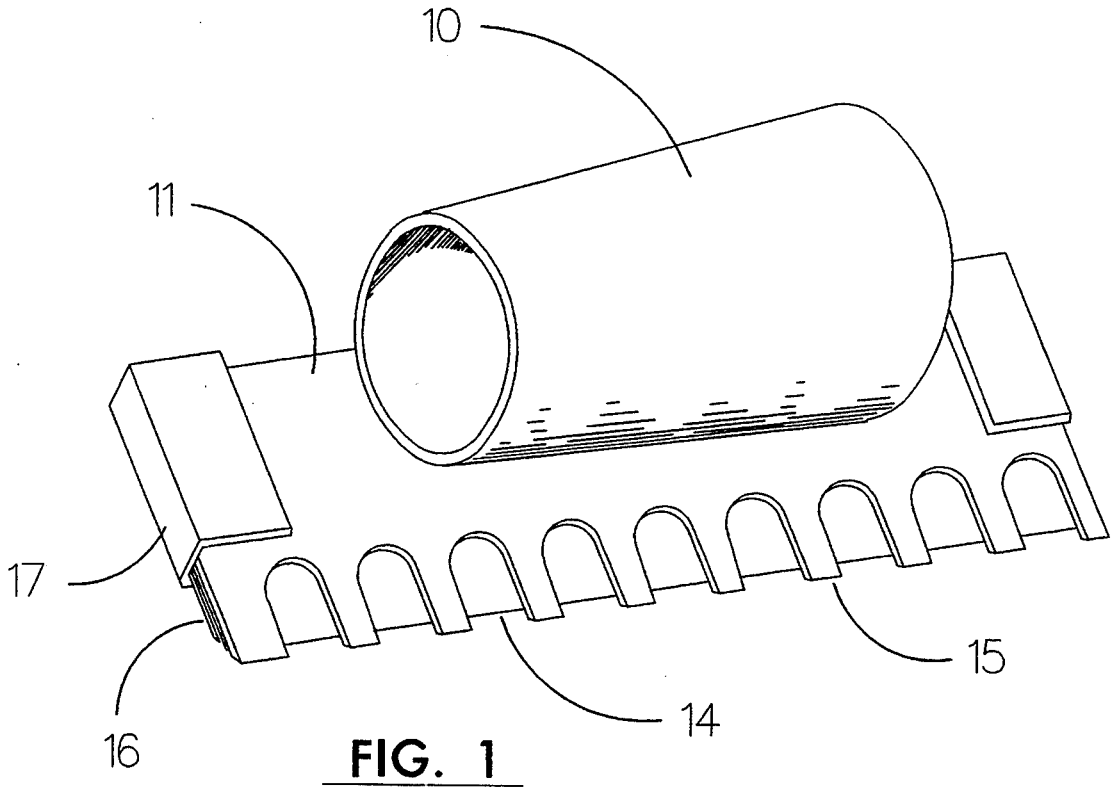
FIG. 1 shows an enlarged perspective view of the device.
Figure 2:
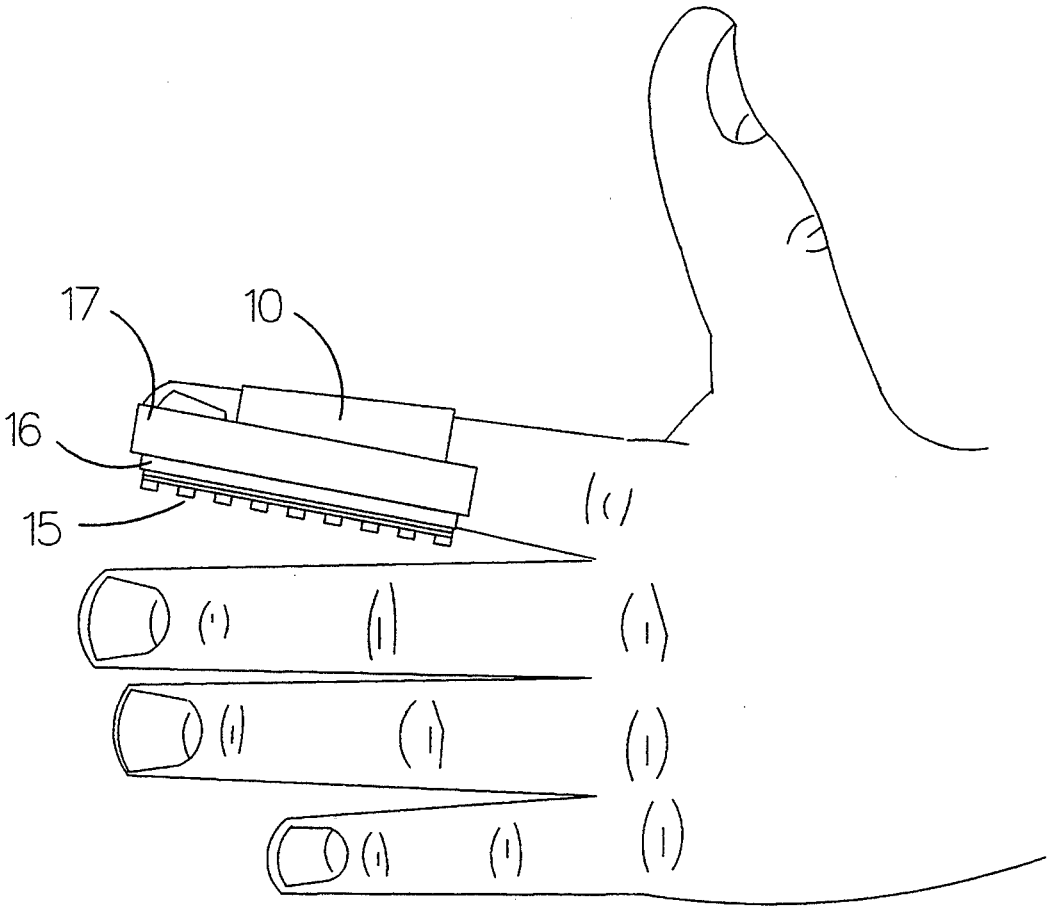
FIG. 2 shows the device inserted on the index finger of a hand.
Figure 3:
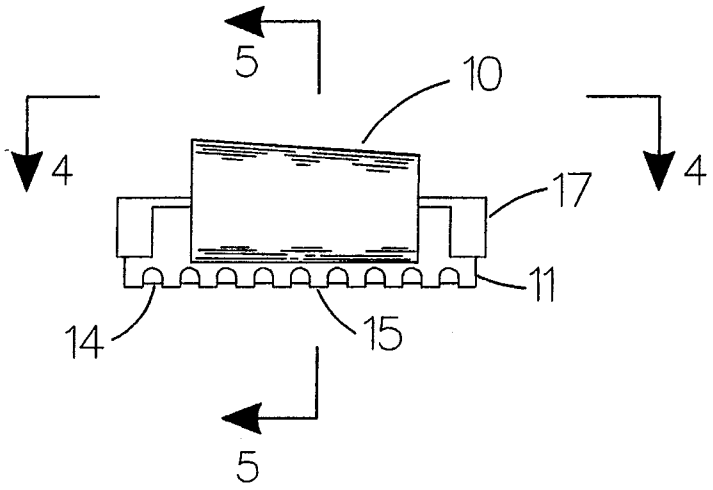
FIG. 3 shows an external view of the device shown in FIG. 1.
Figure 5:
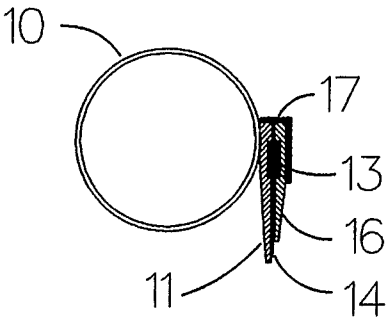
FIG. 5 shows an enlarged cross-sectional view of the device, the section being taken as on Line 5—5 in FIG. 3.
Figure 4:
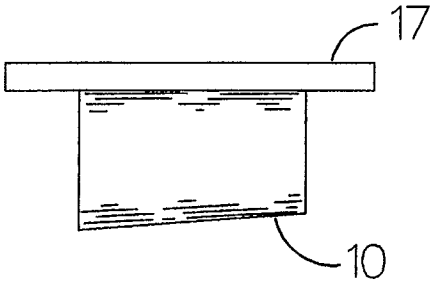
FIG. 4 shows a top view of the device, the view being taken as on Line 4—4 in FIG. 3.

In the embodiment of the invention referring to FIGS. 1 through 6, it is illustrated that the device consists of a finger sleeve 10 made of a rigid material. This finger sleeve 10 is designed for the insertion of a finger of either hand.

Attached to the finger sleeve 10 is a fixed base plate 11. This base plate is made of a rigid rustproof material. The base plate 11 is notched out at the top 12 to provide for the shoulders 13 of the razor blade 14. At the bottom of the base plate 11 there are plural teeth 15. This allows more surface area of the razor blade 14 to be exposed.

The razor blade 14 is held between this base plate 11 and a top plate 16. The top plate 16 being made of the same material as the base plate 11. The top plate 16 is also notched at the top 12 for the shoulders of the razor blade 13. The top plate 16 is shorter than the base plate 11 to allow for the razor blade 14 to be fully exposed. The razor blade is held between the base plate 11 and the top plate 16 by the retainer 17.

The retainer 17, being a rustproof material, encases the base plate 11 and the top plate 16 in such a manner that the razor blade is held tightly in place.

The foregoing is considered illustrative of the principles of the invention. Further, since numerous modifications and changes will readily occur to those skilled in the art, it is not desired to limit the invention to the exact construction and operation shown and described, and accordingly, all suitable modifications and equivalents may be restored to, falling within the scope of the invention as claimed.

What is claimed is:

1. A finger razor device comprising:

a finger sleeve for the insertion of a finger from either hand of a user;

means attached to said finger sleeve for retaining a razor therein, said means including a base plate with teeth spaced along a bottom portion thereof; and a razor fastened within said receiving means, whereby hair may be simultaneously held and cut using only one hand of the user.

2. The device of claim 1, wherein the receiving means includes a top plate and a retainer, whereby the razor is held tightly between the base plate and top plate by said retainer.

3. The device in claim 1, wherein the razor is a razor blade.

4. The device in claim 1, wherein the finger sleeve and the receiving means are molded around the razor blade as one piece making the entire device disposable.

* * * * *